US006094887A

United States Patent [19]

Swank et al.

[11] Patent Number: 6,094,887

[45] Date of Patent: Aug. 1, 2000

[54] ULTRAVIOLET ENERGY AND VAPOR-PHASE HYDROGEN PEROXIDE STERILIZATION OF CONTAINERS

[75] Inventors: Ronald Swank, Crystal Lake; Sevugan Palaniappan, Grayslake, both of Ill.

[73] Assignee: Tetra Laval Holdings & Finance, SA, Pully, Switzerland

[21] Appl. No.: 09/143,587

[22] Filed: Aug. 31, 1998

Related U.S. Application Data

[63] Continuation-in-part of application No. 08/911,967, Aug. 15, 1997, Pat. No. 6,039,922.

[51] Int. Cl.[7] ..... B65B 55/04

[52] U.S. Cl. ..... 53/426; 53/412; 53/167; 53/133.2; 422/24

[58] Field of Search ..... 53/167, 425, 426, 53/410, 412, 133.2, 133.4; 422/24; 493/87

[56] References Cited

U.S. PATENT DOCUMENTS

| | | | |
|---|---|---|---|
| 4,289,728 | 9/1981 | Peel et al. | 422/24 |
| 4,375,145 | 3/1983 | Mosse et al. | 53/425 |
| 4,979,347 | 12/1990 | Shibauchi et al. | 53/167 |
| 5,350,568 | 9/1994 | Tuckner et al. | 53/426 X |
| 5,433,920 | 7/1995 | Sizer et al. | 422/24 |
| 5,809,739 | 9/1998 | Eno | 53/267 |
| 5,843,374 | 12/1998 | Sizer et al. | 53/425 X |

FOREIGN PATENT DOCUMENTS

| | | |
|---|---|---|
| 0361858 | 4/1990 | European Pat. Off. . |
| 62-4038 | 1/1987 | Japan . |
| 2-4621 | 1/1990 | Japan . |
| 8072255 | 4/1997 | Japan . |
| 97/35768 | 10/1997 | WIPO . |

*Primary Examiner*—Daniel B. Moon
*Attorney, Agent, or Firm*—Welsh & Katz

[57] ABSTRACT

The present invention discloses a method and apparatus for sterilizing packaging with vapor-phase hydrogen peroxide and ultraviolet radiation on a packaging machine. A partially formed carton is sprayed with gaseous hydrogen peroxide from a hydrogen peroxide nozzle. The carton is then conveyed to a UV radiation source for irradiation of the carton with UV energy. The carton is then dried with heated air to flush/remove any residual hydrogen peroxide. The present invention sterilizes the carton allowing for filling of the carton with a desired product such as milk, juice or water. The invention allows for the efficacious use of hydrogen peroxide having a concentration of up to 53% while providing a carton having less than 0.5 ppm hydrogen peroxide.

2 Claims, 6 Drawing Sheets

ULTRAVIOLET ENERGY AND VAPOR-PHASE HYDROGEN PEROXIDE STERILIZATION OF CONTAINERS

CROSS REFERENCES TO RELATED APPLICATIONS

This application is a continuation-in-part application of U.S. patent application Ser. No. 08/911,967 filed on Aug. 15, 1997, now U.S. Pat. No. 6,039,922 and hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to the sterilization of containers on a packaging machine. Specifically, the present invention relates to an apparatus and method for the sterilization of containers using ultraviolet energy and vapor-phase hydrogen peroxide.

2. Background Art

Milk or juice is often packaged in cartons that have been sterilized to prolong shelf life of the contents under refrigeration. When milk or juice is being packaged under aseptic packaging conditions, the content are capable of being stored for a substantial period of time at room temperature without spoilage. Both of these packaging processes require effective sterilization of the packaging material prior to filling of a container formed from the packaging material. For example, a container, such as a gable-top container, that has previously been formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

U.S. Pat. No. 4,289,728, discloses a method for sterilization of the surfaces of food containers and other materials by applying a hydrogen peroxide solution, followed by ultraviolet radiation. This patent indicates that the peak intensity of ultraviolet radiation occurs at a wavelength of 254 nm. The concentration of the hydrogen peroxide solution is less than 10% by weight, and furthermore, the hydrogen peroxide solution is heated during or subsequent to irradiation.

UV sterilization has been shown to be suitable for sterilization of flat films but has been found to have limited applicability to preformed, angular containers (Maunder, 1977) due to the geometric and physical constraints associated with UV light. If a simple UV lamp is placed in close proximity above a preformed, such as a gable top carton, the sterilization effectiveness is severely limited due to several reasons. The total light flux entering the carton is restricted to light that can be directed through the carton opening, which in case of typical gable top cartons are 55×55 mm, 70×70 mm or 95×95 mm. Unreflected light emitted from a line source UV lamp decreases in intensity with the square distance from the light source. Thus, as the depth of the carton increases, the light intensity falls off.

Another problem in sterilizing these cartons with UV light is that the light enters the top of the carton and radiates toward the bottom substantially parallel to the sides of the carton. The germicidal effect of the light that impinges on the side is very low because of the high angle incidence.

Thus, the sides of the cartons are the most difficult surfaces to sterilize, especially for tall cartons. When the cartons are positioned on the conveyor, two sides of the carton lie in a plane that is parallel to the axis of the lamp, while the other two sides are transverse to the axis of the lamp. Since the lamp is elongated, radiation impinges on the transverse sides of the carton at a higher angle of incidence than it does on parallel sides of the carton. In the case of a single UV lamp source above the center of a 70×70×250 mm rectangular carton, the effective light intensity at the bottom of the carton would be reduced to 13.9% of the maximum intensity at that distance from the source. The carton sides transverse to the lamp axis receive light from the entire length of the bulb. Light originating from the lamp reflector on the side opposite the parallel carton wall will have a minimum incident angle and thus have an intensity equal to 27.0% of the lamp intensity.

One ultraviolet lamp assembly that is designed to address, among other things, the problem of effective irradiation of pre- formed packages is disclosed in U.S. Pat. No. 5,433,920, to Sizer et al. In accordance with one aspect of the invention disclosed therein, an ultraviolet reflector for use with an ultraviolet lamp is utilized to effectively irradiate the sides as well as the bottom of the container.

A problem with current sterilization practices is the limitation of concentration of hydrogen peroxide which may be used on packaging material for food. Only a minute quantity of hydrogen peroxide residue may be found on the packaging which limits most applications to less than 1% concentration.

BRIEF SUMMARY OF THE INVENTION

On aspect of the present invention is a method for sterilization of cartons on a form, fill and seal machine. The first step of the method is providing cartons to be sterilized. The next step is subjecting the carton to a predetermined quantity of vapor-phase hydrogen peroxide thereby creating a carton coated with a thin layer of hydrogen peroxide. The next step is irradiating the coated carton with ultraviolet radiation for a predetermined set of time thereby creating an irradiated carton. The next step, and possibly final step is drying the irradiated carton with heated air for a predetermined amount of time thereby creating a sterilized carton having less than 0.5 parts per million residue of hydrogen peroxide.

Another aspect of the present invention is a packaging machine for processing a series of cartons. The packaging machine includes a bottom forming station, a conveyor assembly, a vapor nozzle, a vaporizer, an ultraviolet radiation chamber and a hot air distributor. The vapor nozzle applies a predetermined quantity of vapor-phase hydrogen peroxide to the interior and the exposed exterior of each of the partially formed cartons. The vapor nozzle is disposed downline from the bottom forming station and above the conveyor assembly a distance greater than the height of a partially formed carton. The vaporizer transforms a solution of hydrogen peroxide and water into a vapor phase hydrogen peroxide. The vaporizer is disposed above and in flow communication with the vapor nozzle. The ultraviolet radiation chamber irradiates each of the partially formed cartons with ultraviolet energy. The ultraviolet radiation chamber has an ingress and an egress, and is disposed adjacent the vapor nozzle at the ingress. The ultraviolet radiation chamber has an ultraviolet radiation source disposed above the conveyor assembly and a reflector to widely disperse the ultraviolet radiation to provide irradiation of the interior and the exposed exterior of each of the partially formed cartons. The hot air distributor flows hot air into each of the partially formed cartons. The hot air distributor is disposed adjacent the egress of the ultraviolet radiation chamber.

It is a primary object of the present invention to provide a method and apparatus for providing an extended shelf life packaging.

It is yet an additional object of the present invention to provide a method and apparatus for using hydrogen peroxide having a concentration upwards to 53% to sterilize cartons having a residue of hydrogen peroxide less than 0.5 ppm.

BRIEF DESCRIPTION OF SEVERAL VIEWS OF THE DRAWINGS

There is illustrated in FIG. 1 a perspective view of a packaging machine of the present invention.

There is illustrated in FIG. 1A schematic view of apparatus of the present invention integrated on linear form, fill and seal packaging machine.

Figure 2:
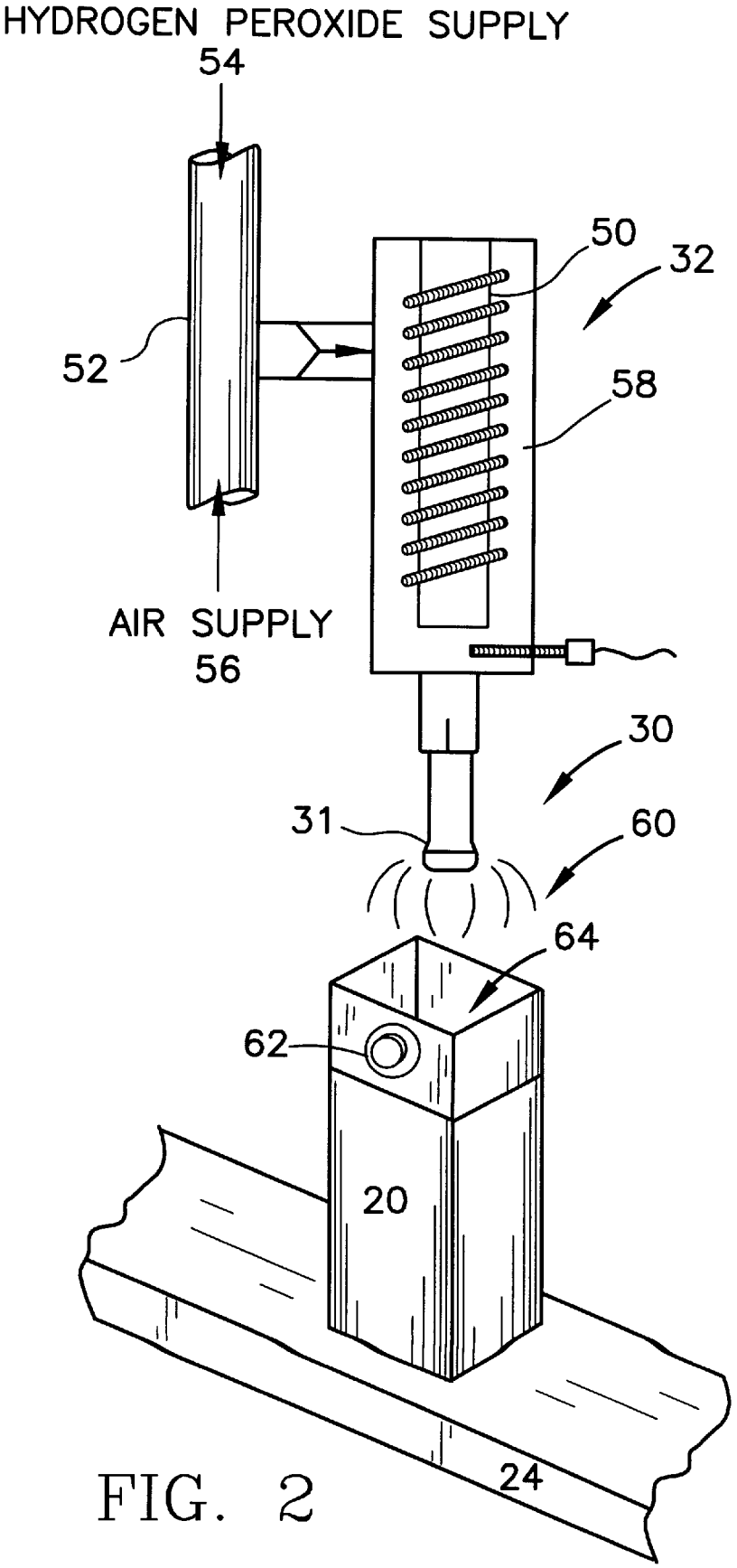

There is illustrated in FIG. 2 a schematic view of the vapor delivery system of the present invention.

Figure 2A:
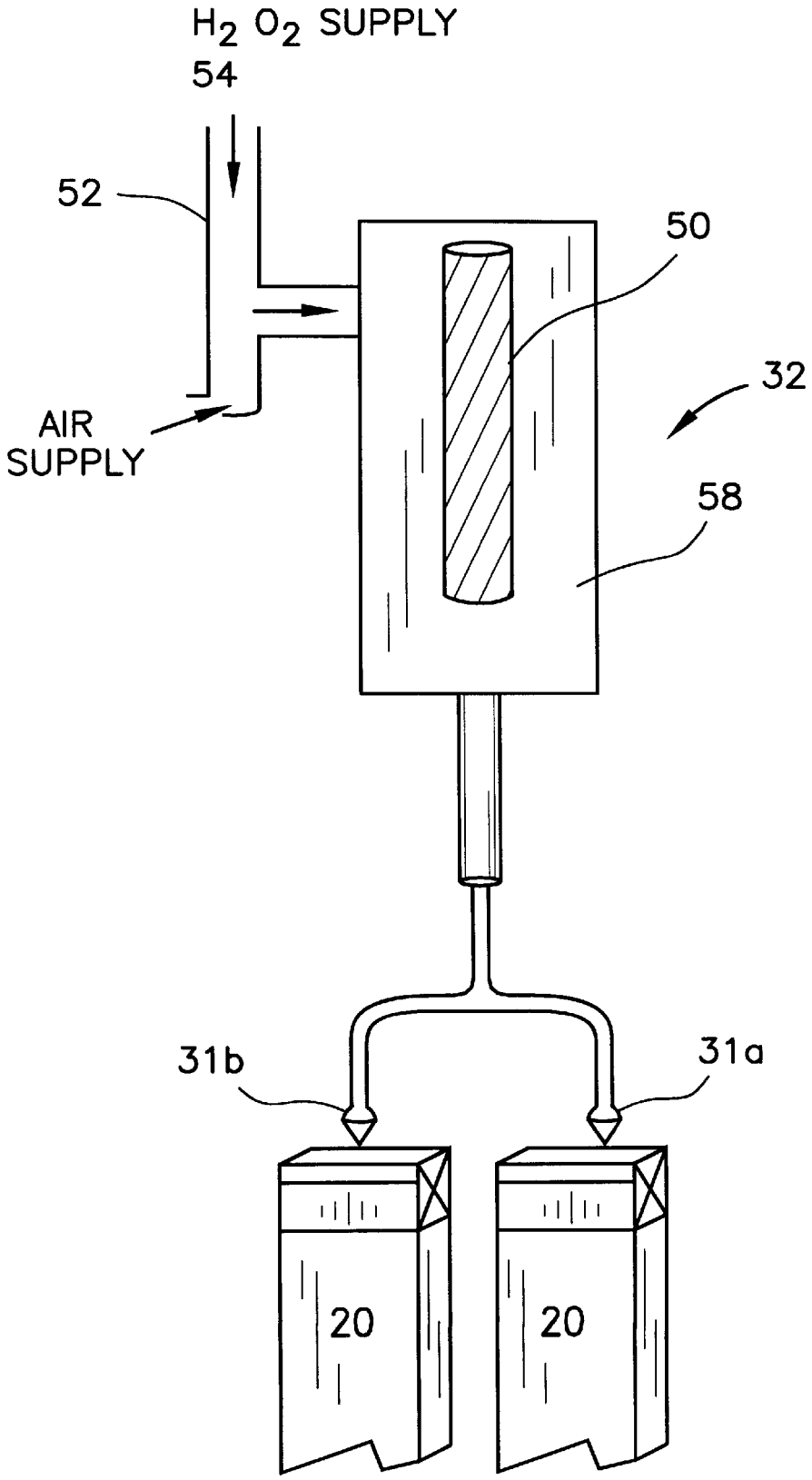

There is illustrated in FIG. 2A a schematic view of the vapor delivery system of the present invention for a dual processing line.

Figure 3:
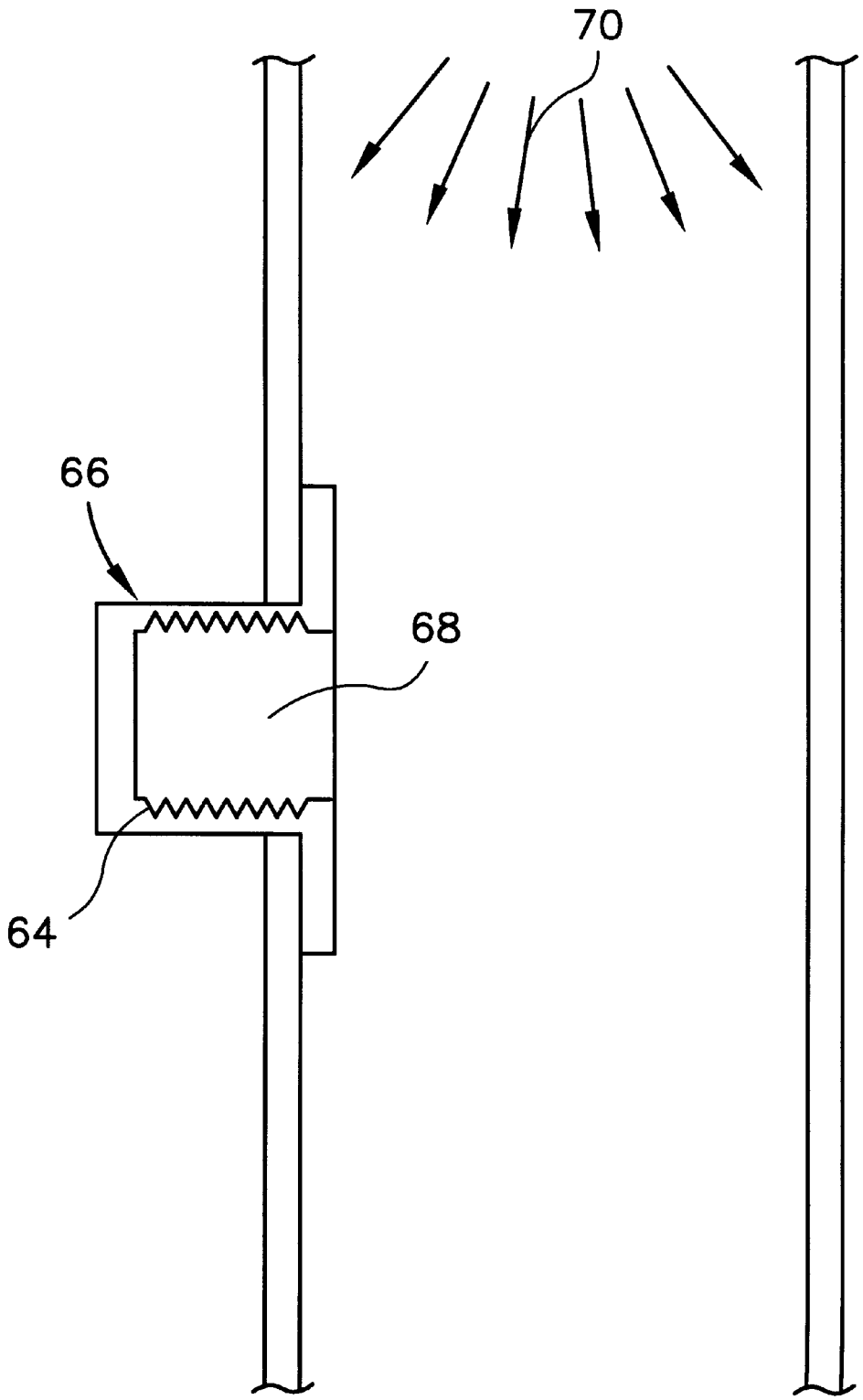
FIG. 3 (prior art)

There is illustrated in FIG. 3 a cross-sectional view of prior art sterilization using liquid hydrogen peroxide.

Figure 4:
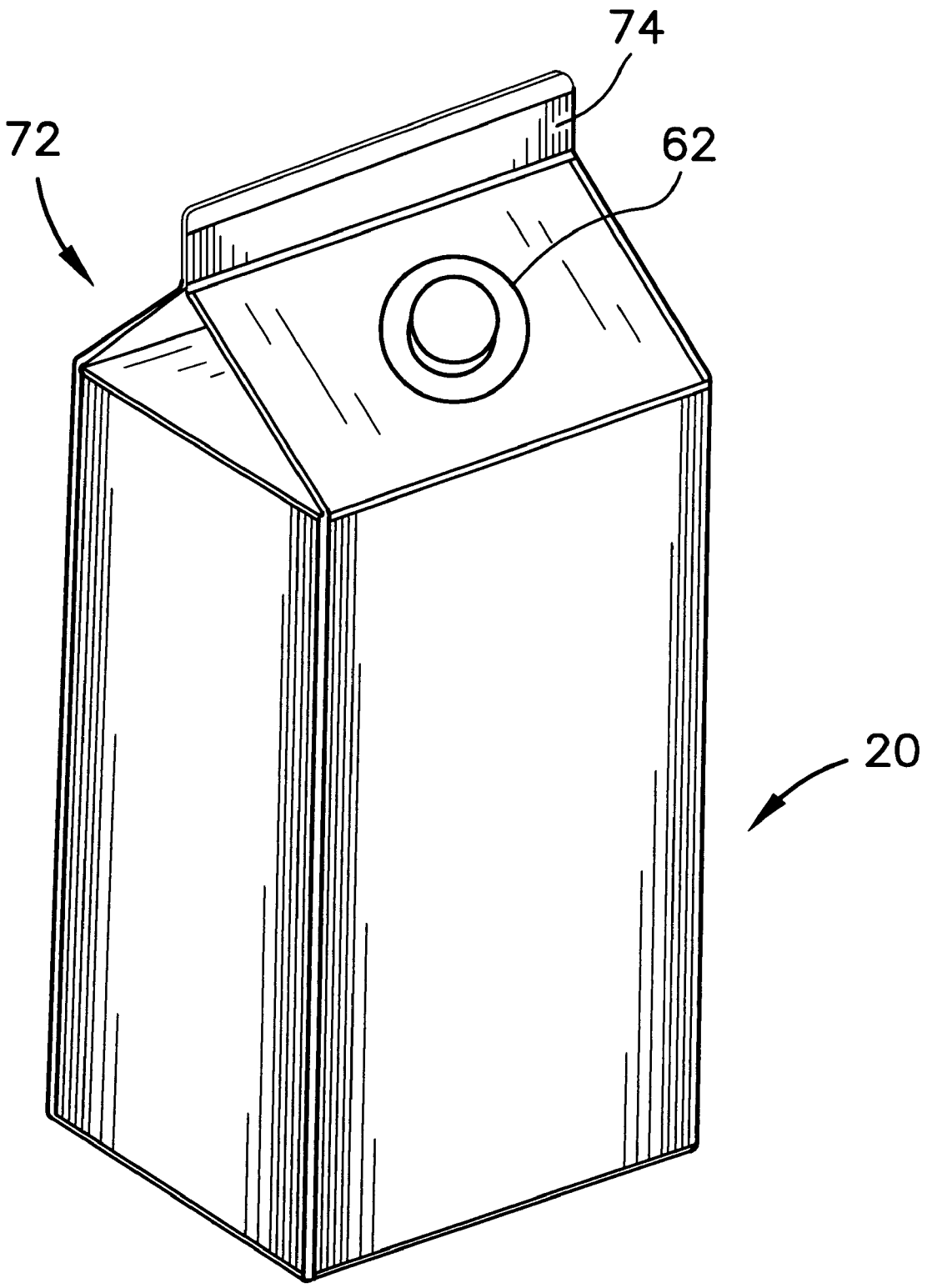

There is illustrated in FIG. 4 a perspective view of a carton capable of being sterilized by the present invention.

DETAILED DESCRIPTION OF THE INVENTION

The present invention applies to the sterilization of containers, whether partially formed or not, undergoing fabrication to a package having an extended shelf life. Such a container may take the form of a fiberboard carton such as a TETRA REX® gable top carton. An application of the present invention is with containers fabricated along a horizontal conveyance system on a multiple station form, fill and seal packaging machine such as the TETRA REX® packaging machine available from Tetra Pak. Although application of the present invention has been described in reference to fabrication with the above-mentioned containers and on the above-mentioned machine, those skilled in the pertinent art will recognize that the application of the present invention with the fabrication of other containers are well within the scope of the present invention.

A common form of container for milk or juice is the gable top carton although some cartons no longer have a gable top. The carton has a paperboard substrate with a plastic (usually polyethylene) coating on the inside and the outside that enables the top of the carton to be closed and sealed after filling. Gable top cartons, standard or modified, are usually fabricated on a linear, multiple station, form, fill and seal packaging machine. An example of such a machine is the TETRA REX® packaging machine available from Tetra Pak.

Figure 1:
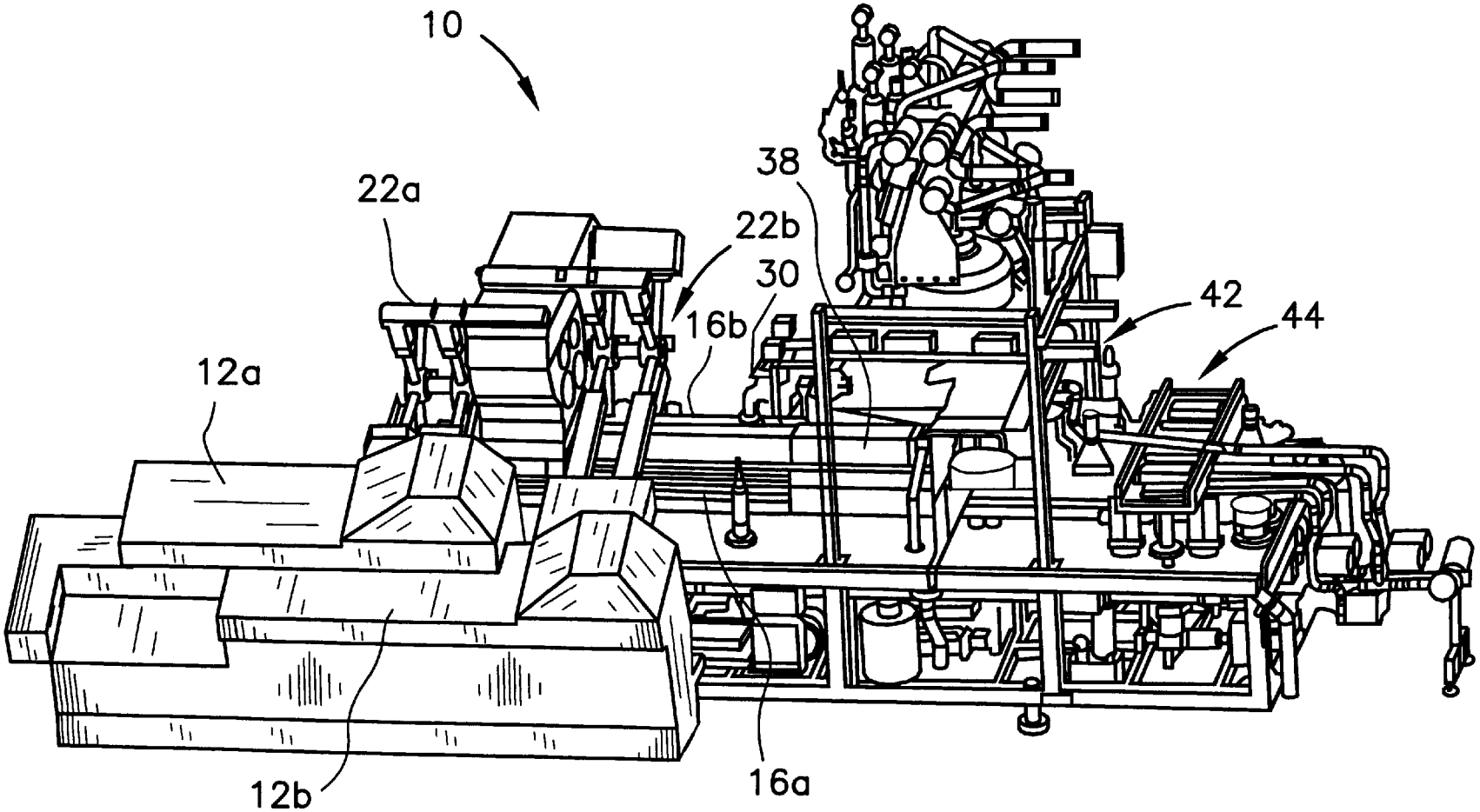

Referring to FIG. 1, a packaging machine 10 is shown without its shell that encloses a good portion of the machine, however, still permits exposure to the environment about the machine. The packaging machine 10 is a dual line packaging machine that is capable of dual processing, that is processing two cartons simultaneously on each line. Carton blanks are fed from a set of magazines 12*a–b* to respective bottom forming mandrel wheels 22*a–b*. The cartons 20 usually have a square bottom which is formed and heat sealed on the bottom forming mandrel wheels 22. The cartons 20 are then placed on a conveyor line 24*a* or 24*b* which advances at a predetermined interval (indexing) to the right as viewed in FIG. 1. The cartons 20 have a hollow interior with an open top end. The cartons 20 are placed within a carton pocket formed by the continuous chains that are part of the conveyor line 24*a–b*. The cartons 20 are placed equidistant apart and advance a predetermined number of carton positions during each periodic advancing step of the conveyor line 24. Between each advancing step of the conveyor line 24, the cartons 20 generally remain stationary for processing for the predetermined interval. The predetermined interval usually corresponds to the slowest process on the line in the fabrication of the carton. The slowest process is usually the sealing of the top of the carton after filling with a desired product. A carton 20 will wait for the predetermined interval, then proceed toward the next station, two carton pocket lengths at a time since the machine is a dual processing machine.

After the cartons are placed on the conveyor line 24, the cartons 20 may optionally proceed to a fitment applicator station 26. Other machines may not have a fitment applicator, or may apply the fitment post-processing. In such situations, the cartons 20 proceed directly toward a hydrogen peroxide application station 30.

The application station 30 may have a nozzle 31 for dispensing a hydrogen peroxide gas onto each of the cartons 20, and in a preferred embodiment is a continuous flowing applicator. The nozzle 30 flows the gas over and around the carton during the predetermined interval. The hydrogen peroxide gas condenses on the carton 20 thereby coating the carton 20 with a very thin layer of hydrogen peroxide. If the condensed coating of hydrogen peroxide is too thick, the ultraviolet radiation may not be effective in destroying microorganism since the hydrogen peroxide will block the ultraviolet radiation.

A vaporizer 32 is disposed above of the nozzle 31 at the application station 30. The vaporizer 32 transforms a solution of hydrogen peroxide into the vapor phase by heating the solution above the gas temperature of hydrogen peroxide, 175° C. On a dual processing line, the vaporizer 32 will be utilized for two nozzles 31 that are in flow communication with the single vaporizer 32. The dual nozzle system would have each nozzle 31 positioned over a carton pocket and connected to the vaporizer 32 by piping to form an inverted "U".

Figure 1A:
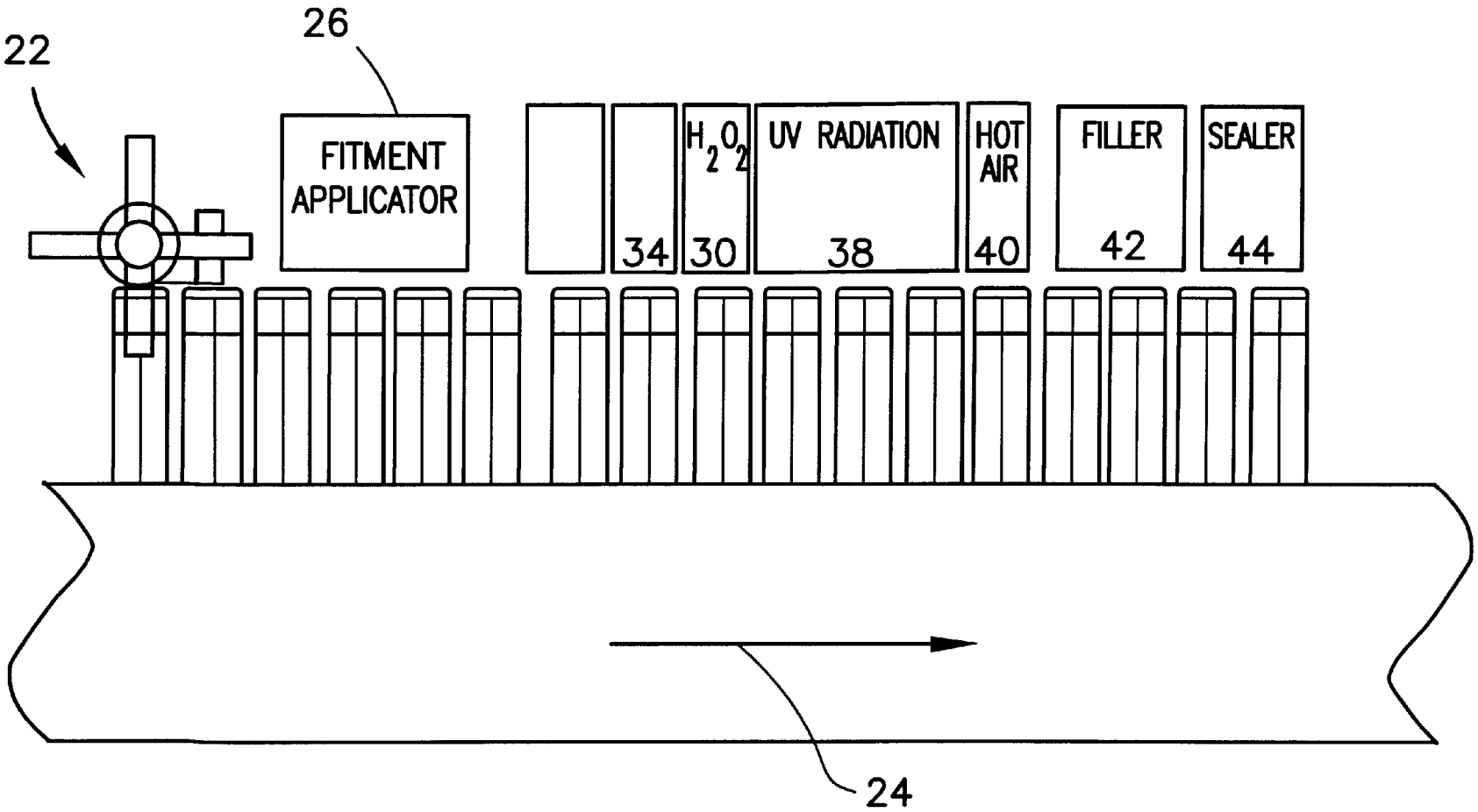

Next, each of the cartons 20 is conveyed to the ultraviolet (UV) radiation chamber 38. Inside the chamber 38, an ultraviolet light source 39 irradiates each of the coated cartons 20 with UV radiation thereby providing a synergistic sterilization effect between UV radiation and hydrogen peroxide. As mentioned previously, if the hydrogen peroxide coating is too thick, then the synergistic effect may be reduced resulting in a lower kill rate. As shown in FIG. 1A, the UV chamber 38 is has a length of approximately six carton pockets on the conveyor line 24. Thus, as shown, each of the cartons 20 is subjected to UV radiation for three predetermined intervals of time since it is a dual processing machine. The UV radiation may be UV-C, excimer UV light, or the like. A possible reflector for dispersing the UV radiation is described in U.S. Pat. No. 5,433,920. Due to possible danger to an operator of the machine 10, the UV light 39 is shielded within the chamber 38.

Upon egress from the chamber 38, each of the cartons 20 is conveyed to a hot air distributor 40 for drying the cartons 20 and for flushing/removing any hydrogen peroxide residue from the cartons 20. Once the each of the cartons 20 is flushed with hot air, only 0.5 parts per million (ppm) should be present in each of the cartons 20. Each of the cartons 20 is conveyed to a filling station 42 for filling the carton with a desired product such as milk or juice. Then to a heat sealing station 44 for sealing the open end of each of the cartons 20, usually the top, which was not sealed previously thereby creating an extended shelf life product having a defect rate of less than 1 in a thousand. A spoiled product, one without sufficient shelf life is considered defective.

Optionally, a pre-breaker 34 station may be placed prior to the applicator station 30 in order to bend the top panels of each of the cartons 20. Additionally, an optional second hot air distributor 36 may be provided for flushing hydrogen peroxide from each of the coated cartons 20 prior to entering the UV chamber 38. However, another embodiments may not have a hot air distributor 36, and such is not necessary for practicing the present invention.

FIG. 2 shows the vapor delivery system of the present invention. The vapor delivery system essentially consists of the nozzle 31 and the vaporizer 32. The vaporizer 32 may be a heat exchanger 50 that receives air and hydrogen peroxide through a conduit 52. The conduit is in flow communication with a hydrogen peroxide source 54 and an air supply 56. As the liquid solution of hydrogen peroxide enters the chamber 58 of the vaporizer 32, it is heated to a temperature in excess of 175° C., the vaporization temperature of hydrogen peroxide. In an alternative embodiment, the vaporizer 32 may transform the solution of hydrogen peroxide into vapor through increasing the pressure instead of the temperature.

The vapor phase hydrogen peroxide flows through a second conduit 59 to the nozzle 31 where it is sprayed onto a carton 20 as illustrated by arrows 60. The nozzle 31 may have a plurality of distribution of openings sufficient to widely disperse the gas. When the gas exits the applicator, its temperature may have decreased, however, the hydrogen peroxide is still in the vapor or gaseous state. The flow of hydrogen peroxide is continuous in a preferred embodiment, however, it is within the scope of the present invention to have intermittent spraying of the hydrogen peroxide gas.

The hydrogen peroxide gas enters and may condense on the opened interior 64 of each of the cartons 20, the exposed exterior of each of the cartons 20, and also, if appliable, on the fitment 62. As previously stated, the carton is stationary for the predetermined interval during which a predetermined amount of hydrogen peroxide gas may condense on the carton 20. For example, the predetermined interval may be 1.2 seconds.

Notable the present invention sterilizes the interior portion of the spout assemblies/fitment 64. In this respect, it is noted in FIG. 3 (the prior art) that each spout assembly may be functionally comprised of two sections: an exterior section 66, that, upon application to the respective carton 20 is disposed toward the exterior of the carton 20; and, an interior section 68 that, upon application to the respective carton 20 is disposed toward the interior of the carton 20. Generally, as illustrated in FIG. 3, sterilization of the interior sections of the spout assemblies/fitments 64 is neglected in that the interior sections 68 are difficult to access once the spout assemblies/fitments 64 have been attached to the respective carton 20. For example, a dispersion of liquid hydrogen peroxide, illustrated with arrows 70, fails to reach certain interior portions of the spout assembly/fitment 64. Such regions effectively become "shadowed" regions that do not receive an application of hydrogen peroxide. Accordingly, post-attachment container sterilization with liquid hydrogen peroxide frequently leaves substantial portions of the spout assembly in a septic state that may contaminate the contents of the carton, and thereby lowering its effective shelf life. By spraying gaseous hydrogen peroxide into and around the carton, such problems are reduced or eliminated.

There is shown in FIG. 4 a fully formed, sealed and filled gable top carton 20 fabricated using the present invention. The carton has the familiar gable top 72 which is accented by the top fin 74. The top fin is either heat sealed or ultrasonically sealed to prevent contamination of the carton 20 and the desired product contained therein. The fitment 62 is provided to access the contents of this carton 20, however, more traditional cartons would have an integrated pour spout accessed by tearing open a portion of the gable top 72.

It should be noted that UV radiation is used synonymously with UV energy, since the amount of UV radiation is determined in watts or joules.

The present invention will be described in the following examples which will further demonstrated the efficacy of the novel sterilization method and apparatus, however, the scope of the present invention is not to be limited by these examples.

UV-H2O2 Vapor Test w/Cartons Inoculated with BSA Spores Purpose

The purpose for this series of runs was to start developing the optimum conditions for running vapor H2O2 in place of liquid H2O2 using cartons inoculated with Bacillus subtilis A spores to determine kill levels.

Procedure

For this study 2 liter cartons without screw-caps were inoculated with Bacillus subtilus A Spores using the "swab on/swab off" method. The inoculum, a refrigerated 10 7.5 Bacillus subtilis A Spore suspension, was applied at a volume of 10 $\mu$l to the center of a marked 50 cm2 area on the lower portion of panel 4. A sterile cotton swab was moistened in sterile phosphate buffer and twisted against the side of the test tube to remove the excess liquid. The swab was used to spread the 10 $\mu$l of spores as uniformly as possible over the 50 cm2 area. All cartons, including the uninoculated negative controls, were allowed to dry of 1 hour under the hood. The variables listed in Tables 1 and 2 were ran and plated on Standard Methods Agar and incubated at 30° C. for 48 hours. The results are presented in Tables 1 and 2.

Fixed Parameters:

Hot Air

Condition #15=Air Flow: 30 m/s Temp: 440° C.

Condition #21=Air Flow: 13.8 m/s Temp: 373° C.

Summary of Results

TABLE 1

| Sample ID | Variables | # of Cartons | Avg. Log Reduction | Std. Dev. |
|---|---|---|---|---|
| PC | Positive Controls-No UV, No H2O2, No Hot Air | 10 | 4.56* | 0.15 |
| A | 35% H2O2, No UV, Hot Air After - Condition #15 | 10 | 3.95 | 0.48 |
| B | 35% H2O2, UV, Hot Air After - Condition #15 | 10 | 4.56 | 0.0 |
| C | 35% H2O2, UV, Hot Air Before - Condition #21 | 10 | 4.56 | 0.0 |

TABLE 1-continued

| Sample ID | Variables | # of Cartons | Avg. Log Reduction | Std. Dev. |
|---|---|---|---|---|
| D | 15% H2O2, UV, Hot Air Before - Condition #21 | 10 | 4.56 | 0.0 |

*Log Average

TABLE 2

| Sample ID | Variables | # of Cartons | Avg. Log Reduction | Std. Dev. |
|---|---|---|---|---|
| PC | Positive Controls-No UV, No H2O2, No Hot Air | 10 | 4.56* | 0.15 |
| A | 0.5% H2O2, UV L-6, Hot Air After | 10 | 4.54 | 0.06 |
| B | 2.0% H2O2, UV L-6, Hot Air After | 10 | 4.56 | 0 |
| C | 2.0% H2O2, UV L-8, Hot Air After | 10 | 4.56 | 0 |
| D | 35% H2O2, No UV, Hot Air After - Condition #15 | 10 | 4.45 | 0.09 |
| E | 35% H2O2, UV L-6, Hot Air After-Condition #21 | 10 | 4.56 | 0.0 |
| F | 2% H2O2, UV L-6, Hot Air Before-Condition #21 | 10 | 4.56 | 0.0 |

*Log Average

What is claimed is:

1. A method for sterilization of packaging at a sterilization station on a form, fill and seal machine, the method comprising:

providing packaging to be sterilized at the sterilization station;

partially erecting the packaging to form a partially formed carton;

affixing a fitment on the partially formed carton;

transforming to a vapor phase a solution of hydrogen peroxide having a concentration less than 53%;

subjecting the partially formed carton with a fitment thereon to a predetermined quantity of vapor-phase hydrogen peroxide thereby creating a partially formed carton with the fitment thereon coated with a thin layer of hydrogen peroxide;

condensing the hydrogen peroxide onto the partially formed carton with the fitment thereon;

irradiating the coated partially formed carton with the fitment thereon with ultraviolet radiation for a predetermined set of time thereby creating an irradiated partially formed carton with the fitment thereon; and drying the irradiated partially formed carton with the fitment thereon with heated air for a predetermined amount of time thereby creating a sterilized partially formed carton with the fitment thereon having less than 0.5 parts per million residue of hydrogen peroxide.

2. An apparatus for sterilizing a series of cartons being processed on a multiple station form, fill and seal packaging machine, each of the cartons partially formed and having sidewalls defining a hollow interior, the process occurring at a sterilization station on the packaging machine, the apparatus comprising:

a conveyor assembly for moving each of the partially formed cartons to the sterilization station at a predetermined interval;

a nozzle for subjecting each of the partially formed cartons to a predetermined quantity of vapor-phase hydrogen peroxide for the predetermined interval thereby applying a thin layer of hydrogen peroxide to the interior and the exposed exterior of each of the partially formed cartons;

means for vaporizing hydrogen peroxide to form the vapor-phase hydrogen peroxide having a concentration lower than 53%, the vaporizing means in flow communication with the nozzle;

a heater;

an ultraviolet radiation source for irradiating each of the partially formed cartons with ultraviolet radiation for a multiple of the predetermined interval, the ultraviolet radiation source disposed above the conveyor assembly and having a reflector to widely disperse the ultraviolet radiation to provide irradiation of the interior and the exposed exterior of each of the partially formed cartons; and a hot air distributor capable of flowing hot air onto each of the partially formed cartons, wherein the ultraviolet radiation source is disposed between the heater and the hot air distributor.

* * * * *